US006827160B2

(12) United States Patent
Blair et al.

(10) Patent No.: US 6,827,160 B2
(45) Date of Patent: Dec. 7, 2004

(54) DOWNHOLE MUD MOTOR

(75) Inventors: Paris E. Blair, Casper, WY (US); Joseph L. Ficken, Casper, WY (US); Daniel J. Richards, Casper, WY (US)

(73) Assignee: Hunting Performance, Inc., Casper, WY (US)

( * ) Notice: Subject to any disclaimer, the term of this patent is extended or adjusted under 35 U.S.C. 154(b) by 17 days.

(21) Appl. No.: 10/354,340

(22) Filed: Jan. 30, 2003

(65) Prior Publication Data

US 2003/0111269 A1 Jun. 19, 2003

Related U.S. Application Data

(63) Continuation-in-part of application No. 09/759,400, filed as application No. PCT/US02/01051 on Jan. 14, 2002, now Pat. No. 6,561,290.

(51) Int. Cl.[7] ..... E21B 4/02
(52) U.S. Cl. ..... 175/107; 384/94; 464/143
(58) Field of Search ..... 175/107, 228; 384/93, 94, 97; 964/15, 143

(56) References Cited

U.S. PATENT DOCUMENTS

| | | | | |
|---|---|---|---|---|
| 4,646,856 A | | 3/1987 | Dismukes | |
| 4,697,638 A | | 10/1987 | Knight | |
| 4,772,246 A | | 9/1988 | Wenzel | |
| 5,000,723 A | | 3/1991 | Livingstone | |
| 5,048,622 A | | 9/1991 | Ide | 175/107 |
| 5,069,298 A | * | 12/1991 | Titus | 175/107 |
| 5,097,902 A | * | 3/1992 | Clark | 166/187 |
| 5,163,521 A | * | 11/1992 | Pustanyk et al. | 175/40 |
| 5,195,754 A | * | 3/1993 | Dietle | 277/336 |
| 5,248,204 A | * | 9/1993 | Livingston et al. | 384/97 |
| 5,267,905 A | | 12/1993 | Wenzel et al. | |
| 5,337,840 A | * | 8/1994 | Chancey et al. | 175/107 |
| 5,350,242 A | | 9/1994 | Wenzel | |
| 5,368,108 A | | 11/1994 | Aldred et al. | |
| 5,377,771 A | | 1/1995 | Wenzel | 175/107 |
| 5,520,256 A | | 5/1996 | Eddison | |
| 5,704,838 A | | 1/1998 | Teale | |
| 5,727,641 A | | 3/1998 | Eddison et al. | |
| 5,738,358 A | * | 4/1998 | Kalsi et al. | 277/544 |
| RE35,790 E | | 5/1998 | Pustanyk et al. | |
| 5,911,284 A | * | 6/1999 | von Gynz-Rekowski | 175/107 |
| 5,956,995 A | | 9/1999 | Herben et al. | |
| 6,349,778 B1 | | 2/2002 | Blair et al. | |
| 6,561,290 B2 | * | 5/2003 | Blair et al. | 175/107 |
| 2002/0053471 A1 | * | 5/2002 | Blair et al. | 175/107 |

FOREIGN PATENT DOCUMENTS

| | | |
|---|---|---|
| CA | A1 2023042 | 3/1991 |
| WO | WO 00/46478 | 8/2000 |

* cited by examiner

*Primary Examiner*—William Neuder
(74) *Attorney, Agent, or Firm*—Margaret Polson; Patent Law Offices of Rick Martin, P.C.

(57) ABSTRACT

A downhole mud motor (100) is disclosed which has an improved bearing mandrel (107) and a bearing stop (105) to transfer a larger percentage of the weight of a drill string to the bit. Also improved sealing systems (113) (114) (220) (515(706) for the transmission section and bearing section (116) (310) (117) (118) (119) prevent drilling mud from entering critical components. A piston stop is provided to prevent the piston from damaging other parts as the piston moves under pressure. Compensating pressure assembly (204) preferably including a disk (1408) is placed in the lower housing (108) to prevent pressure from building up in the bearing section (308). A combination of grooved ball seats (130) and circumferentially spaced balls (127) are provided in the transmission section (200) (207) to allow for greater flow of lubricant around the ball bearings.

30 Claims, 23 Drawing Sheets

Completed Pressure Relief Disk Assembly
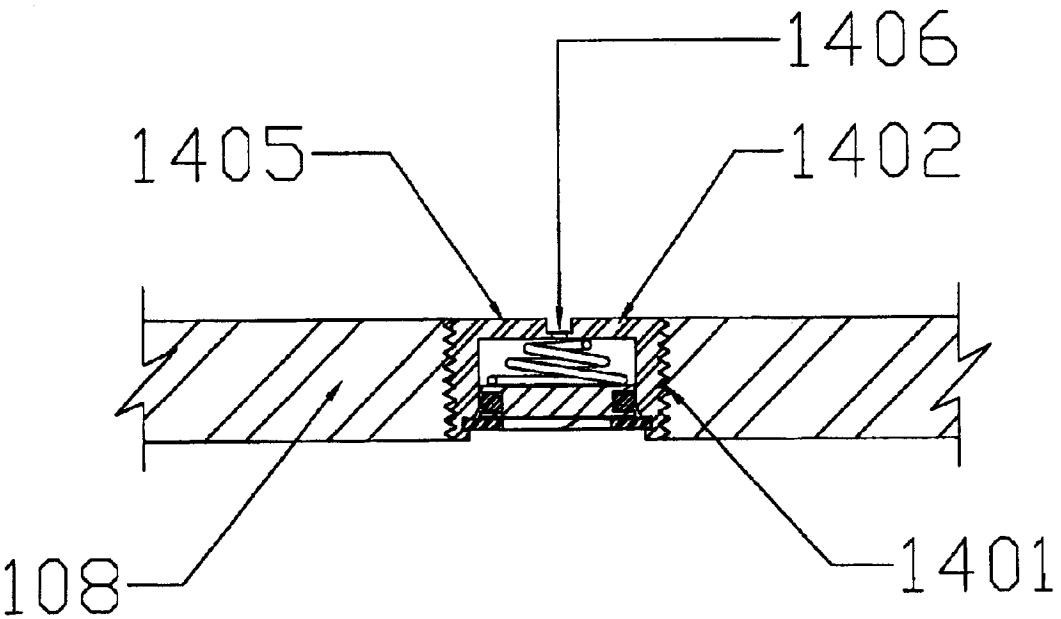
144

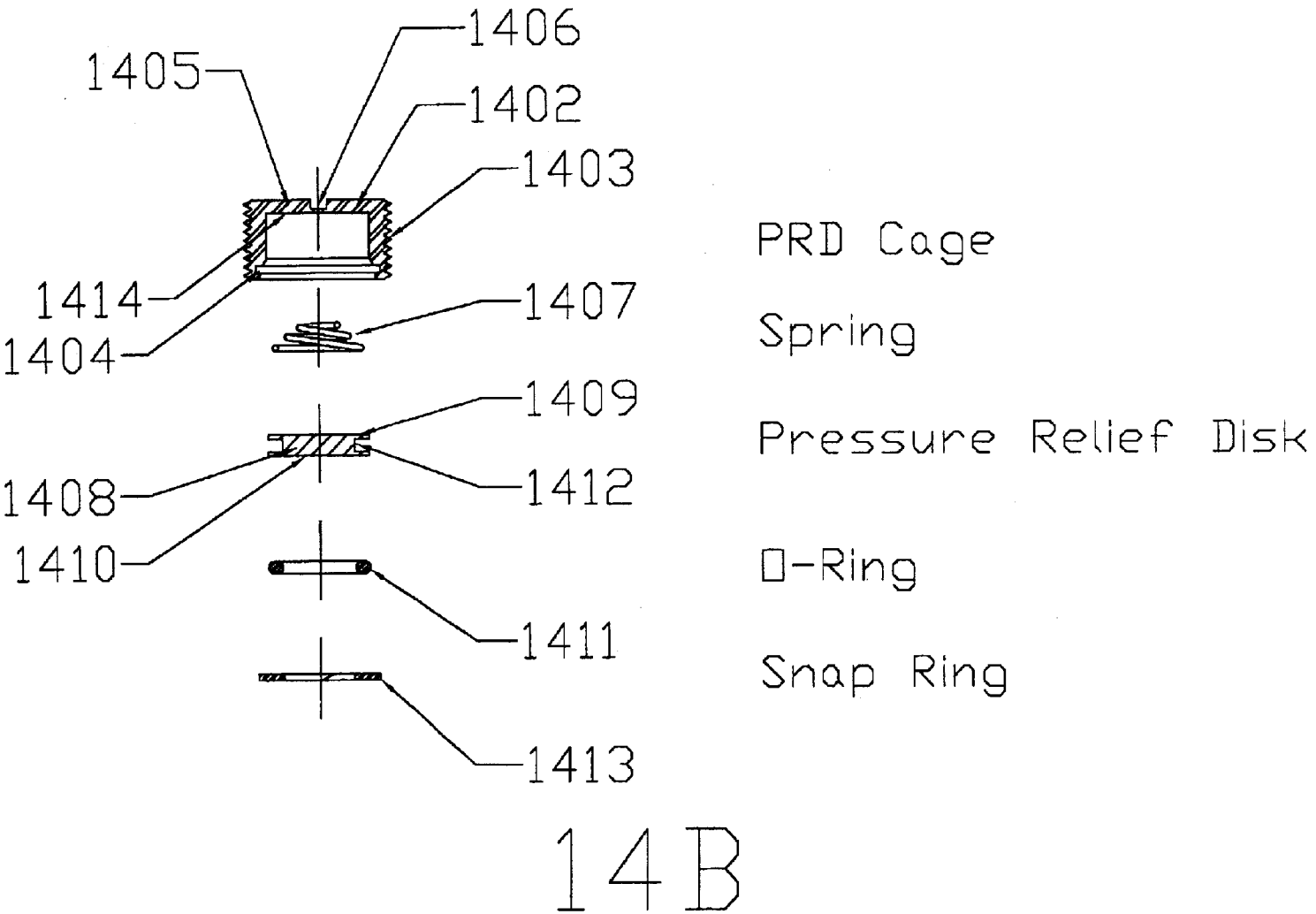
14B

DOWNHOLE MUD MOTOR

CROSS REFERENCE APPLICATIONS

This application is a continuation-in-part of Ser. No. 09/759,400 filed on Jan. 12, 2001 and issued as U.S. Pat. No. 6,561,290 which is a 371 of PCT application PCT/US02/01051 filed on Jan. 14, 2002 and published on Jul. 18, 2002, which claimed priority from Ser. No. 09/759,400.

FIELD OF INVENTION

The present invention relates to drilling with a downhole mud motor, and more particularly a mud motor designed to withstand higher torques and pressure operations.

BACKGROUND OF THE INVENTION

Down-hole motors assemblies are well known in the drilling arts. Mud motors are one well-known type of down-hole motors. Mud motors are used to supplement drilling operations by turning fluid power into mechanical torque and applying this torque to a drill bit. The mud is used to cool and lubricate the drill bit, to carry away drilling debris and to provide a mud cake on the walls of the annulus to prevent the hole from sloughing in upon itself or from caving in all together. Mud motors operate under very high pressure and high torque operations and are known to fail in certain, predictable ways. The failure of a mud motor is very expensive, as the whole drill string must be pulled out of the bore hole in order to bring the mud motor to the surface where it can be repaired or replaced. This is a very time consuming and costly operation. Common problems that occur with prior art mud motors include; seal failure resulting in drilling mud in the universal joint in the transmission section; pressuring up, often called hydraulically locking, due to either fluid or gas being trapped within the confines of the tool itself, and broken bearing mandrels and resulting mud invasion into the bearings.

SUMMARY OF THE INVENTION

The primary aspect of the present invention is to provide a mud motor that will operate for longer periods with fewer failures.

Other aspects of this invention will appear from the following description and appended claims, reference being made to the accompanying drawings forming a part of this specification wherein like reference characters designate corresponding parts in the several views.

A downhole mud motor assembly is disclosed which has an improved bearing mandrel and a bearing stop to transfer a larger percentage of the weight of the drill string to the bit. Also improved sealing systems for the transmission section and bearing section prevents drilling mud from entering critical components. A piston stop is provided to prevent the piston from damaging any parts as the piston moves under pressure. One or more compensating pressure disks are placed in the lower housing to prevent pressure from building up in the bearing section. A grooved ball seat is provided in the transmission to allow for greater flow of lubricant around the 1¼" balls.

BRIEF DESCRIPTION OF THE DRAWINGS

FIGS. 14A and 14B is a cross sectional view of the compensating pressure disk and an exploded cross sectional view, respectively.

Figure 1A:
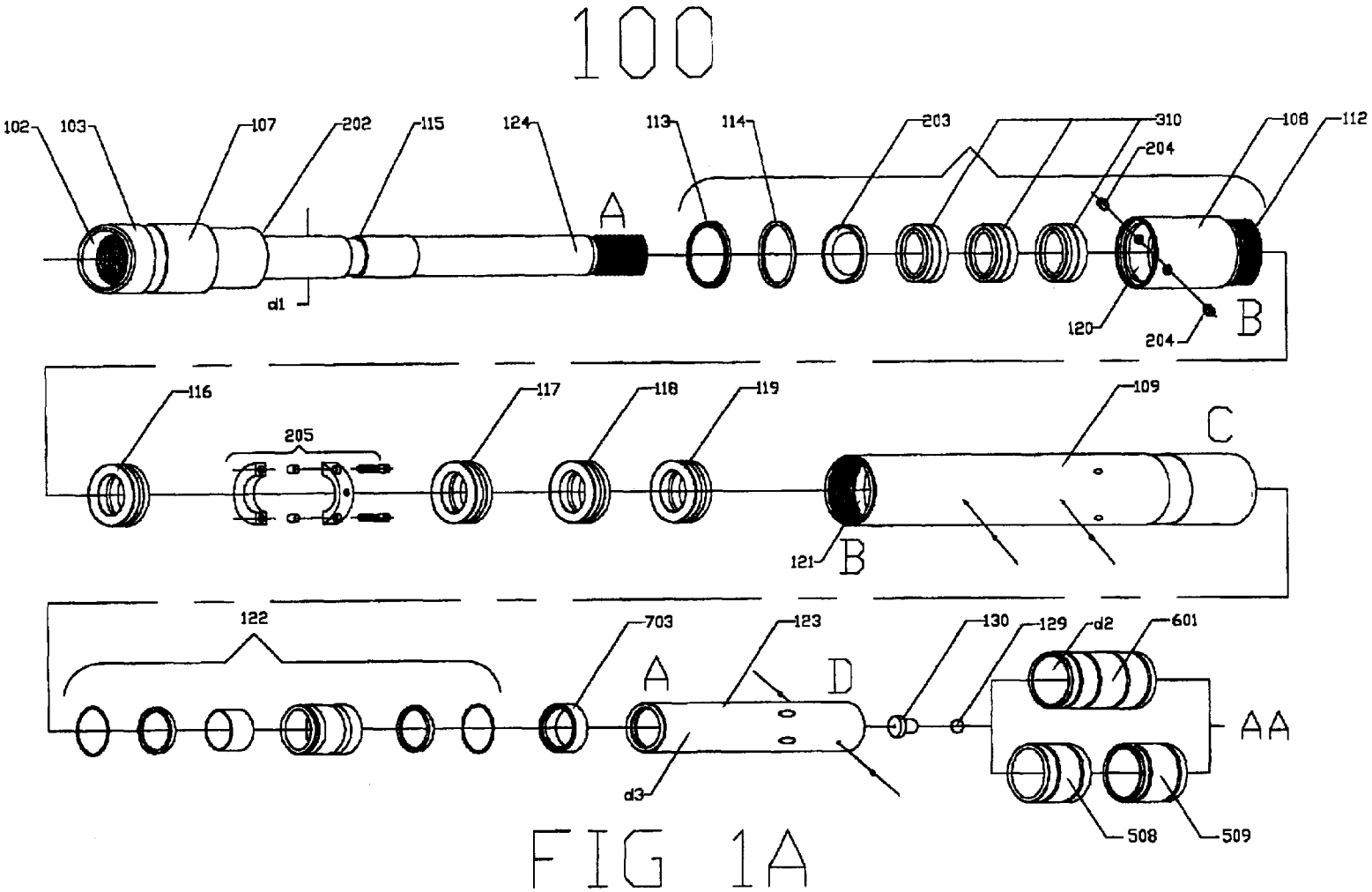
FIGS. 1A through 1B is an exploded view of major components of the present invention.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Parts, shown in the following drawings, toward the left are sometimes referred to as down-hole or forward parts as relating to the drilling direction, which is to the left. The back or trailing end of such parts is to the right. On-bottom drilling means any time the drill bit is actually in contact with and removing material from the formation. Off-bottom is anytime the bit is raised off of the bottom of the hole, and cutting action has stopped. I.e., when a connection is being made or mud is to circulate for some time period. The mud motor 100, as shown in FIGS. 1A–1B, and 2A–2D, attaches to the bit (not shown) at a forward end 102 and the power section 104 at the trailing end. The power section 104 has a rotor 105 and stator 106. The mud motor 100 has a cylindrical bearing mandrel 107 which has a through bore 201, as shown in FIGS. 2A–2C, which carries drilling mud to the bit.

Figure 1B:
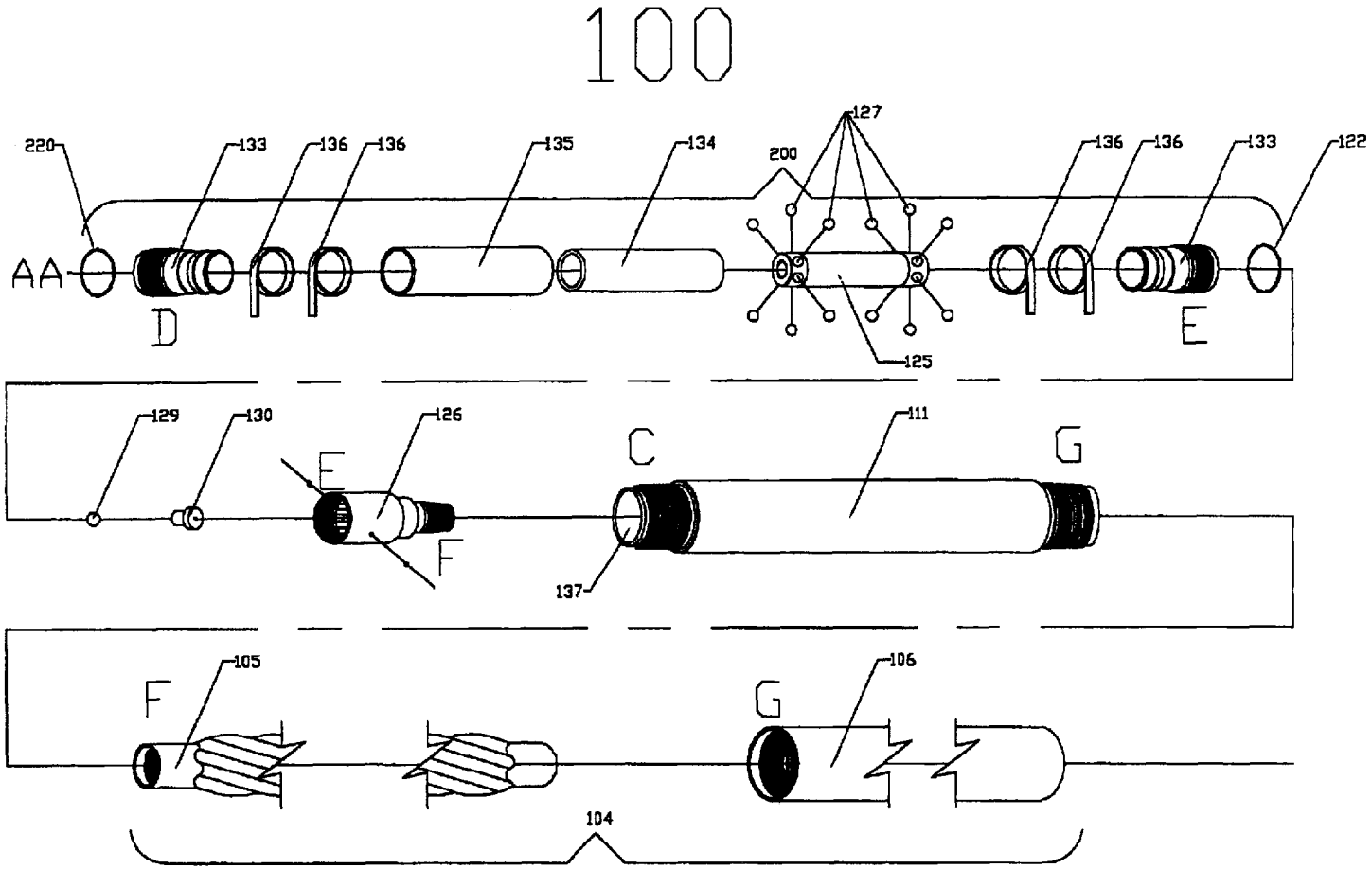
Figure 2A:
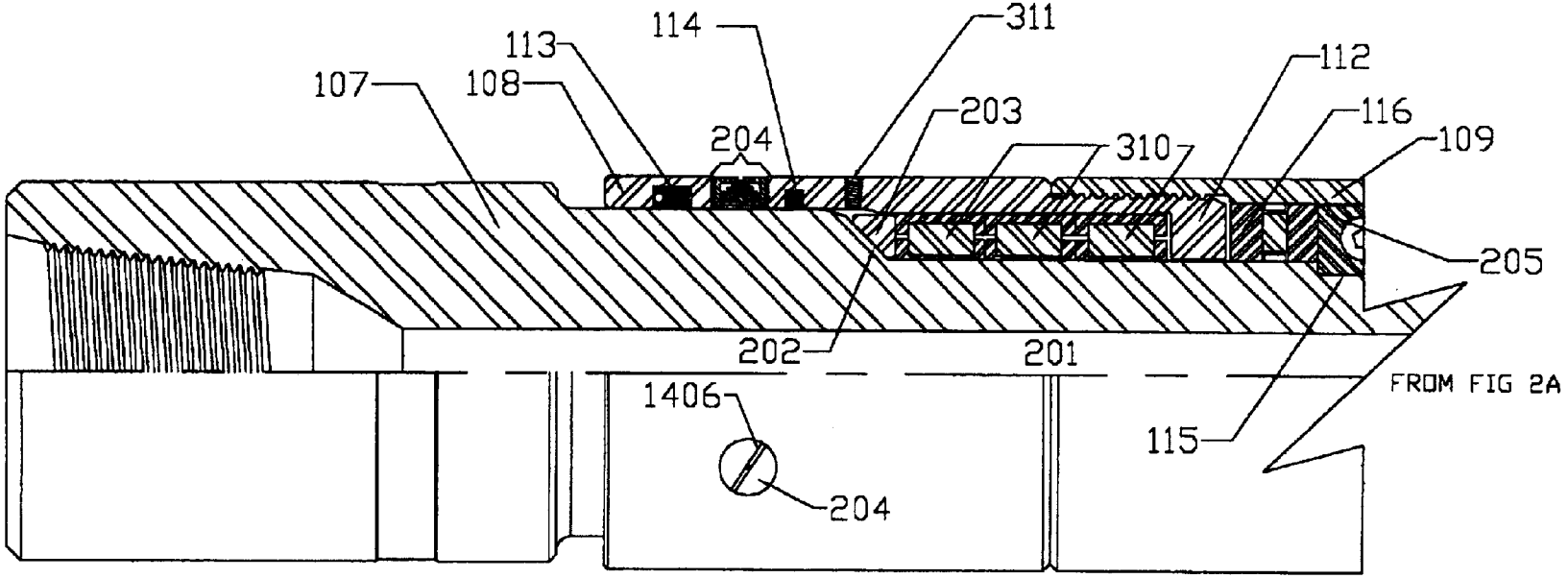
FIGS. 2A through 2D is a longitudinal, partially cut away, cross sectional view of the present invention.
Figure 2B:
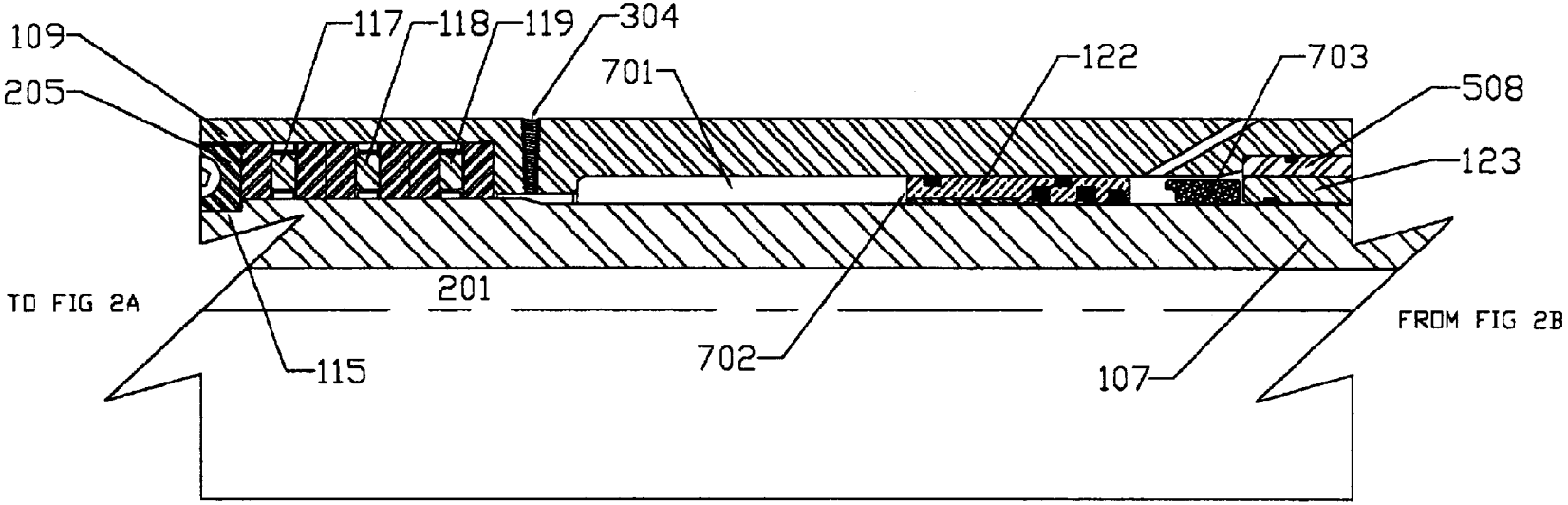
Figure 2C:
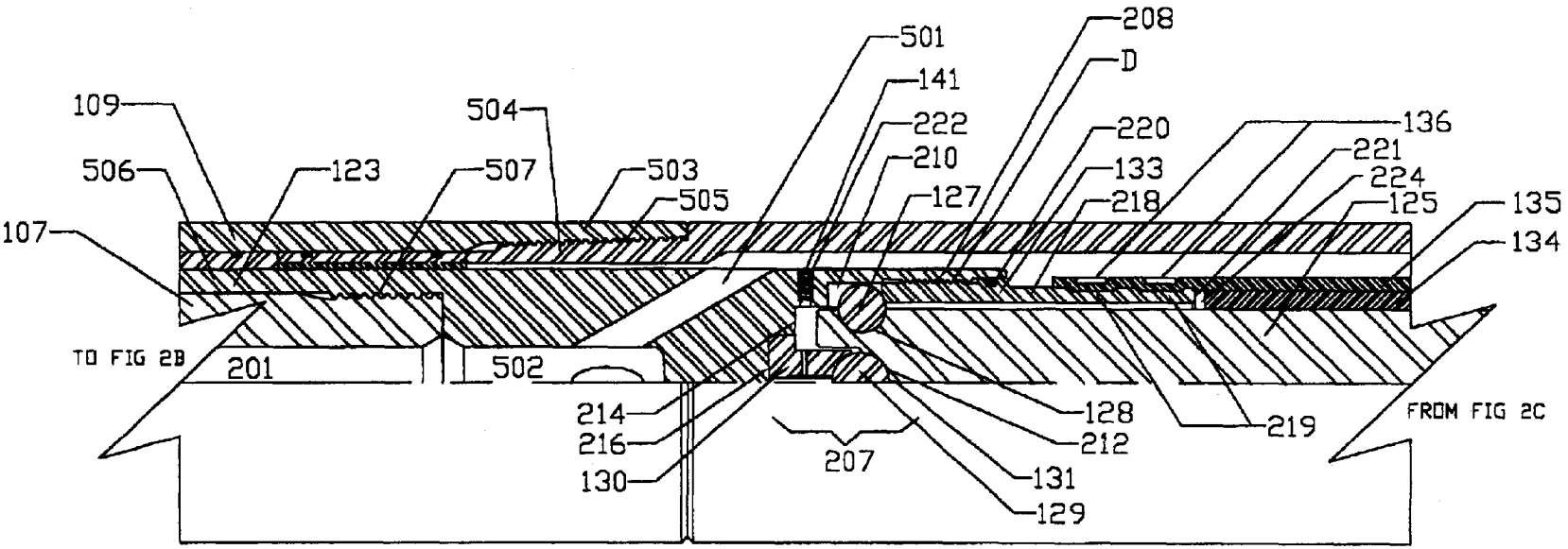

The mud motor 100 has as housing made up of the lower housing 108, the outer housing 109 and the flex housing 111 which are all threaded together in a known manner at points B and C in FIGS. 1A–1B. Each housing has a central through bore 120, 121 and 137 respectively. The bore 120 of the lower housing 108 and the bore 121 of the outer housing 109 fit over the bearing mandrel 107. Near the forward end 102 the bearing mandrel 107 is rotationally supported in the lower housing 108 by a set of radial bearings 310, as shown in FIG. 2A. The bearing mandrel 107 has a frustoconical shoulder 202 where the outer diameter of the bearing mandrel 107 decreases to a bearing diameter of $d_1$, in the preferred embodiment $d_1$=3.935 inches in an outer diameter mud motor of 6.75 inches providing a preferred bearing diameter to mud motor ratio of 0.584. This ratio is given by way of example of the relative size. The invention is not considered to be limited to any particular ratio. The more important aspect of the invention is the shape of the bearing mandrel 107.

The radial ring 203 abuts the first radial bearing 310 and is shaped to fit onto frustoconical shoulder 202. The lower housing 108 is sealed to the bearing mandrel 107, preferably with a poly pack type seal 113. In the preferred embodiment, the poly pack seal 113 used is part number 37505625-625 from Parker Seals, and a Kalsi$^{tm}$ seal 114, part number 344-79-11, to prevent drilling mud from getting into the radial bearings 310.

A compensating pressure assembly 204 is provided to prevent the pressure on the inside of the housing from becoming significantly greater than the pressure on the outside of the housing. As shown in FIGS. 2A and 14A, the pressure assembly 204 is threaded into threaded hole 1401, which is located between seal 113 and seal 114. The area between seal 113 and seal 114 is filled with a fluid, preferably an oil, during assembly. The pressure assembly 204 has a cage 1402 with a threaded exterior wall 1403, a bottom groove 1404, and a top wall 1405. A slot 1406 is formed in the top wall 1405. A spring 1407 is placed against the inner side 1114 of the top wall 1405 and then the outer surface 1409 of pressure relief disk 1408 is placed against spring 1407. O-ring 1411 fits in groove 1412 on the outer circumference of pressure relief disk 1408 to seal the assembly. Snap ring 1413 holds the pressure relief disk 1408 in place when fitted in to bottom groove 1404 and exposes the bottom surface 1410 of the pressure relief disk 1408. As the lubricant filling the bearing region (bearing section) expands the pressure relief disk 1408 is pressed up and compresses spring 1407. There are a plurality of compensating pressure assemblies 204 spaced circumferentially around the lower housing 108. The exact number of pressure disks 204 depends on the application for which the mud motor 100 is to be used.

Figure 11A:
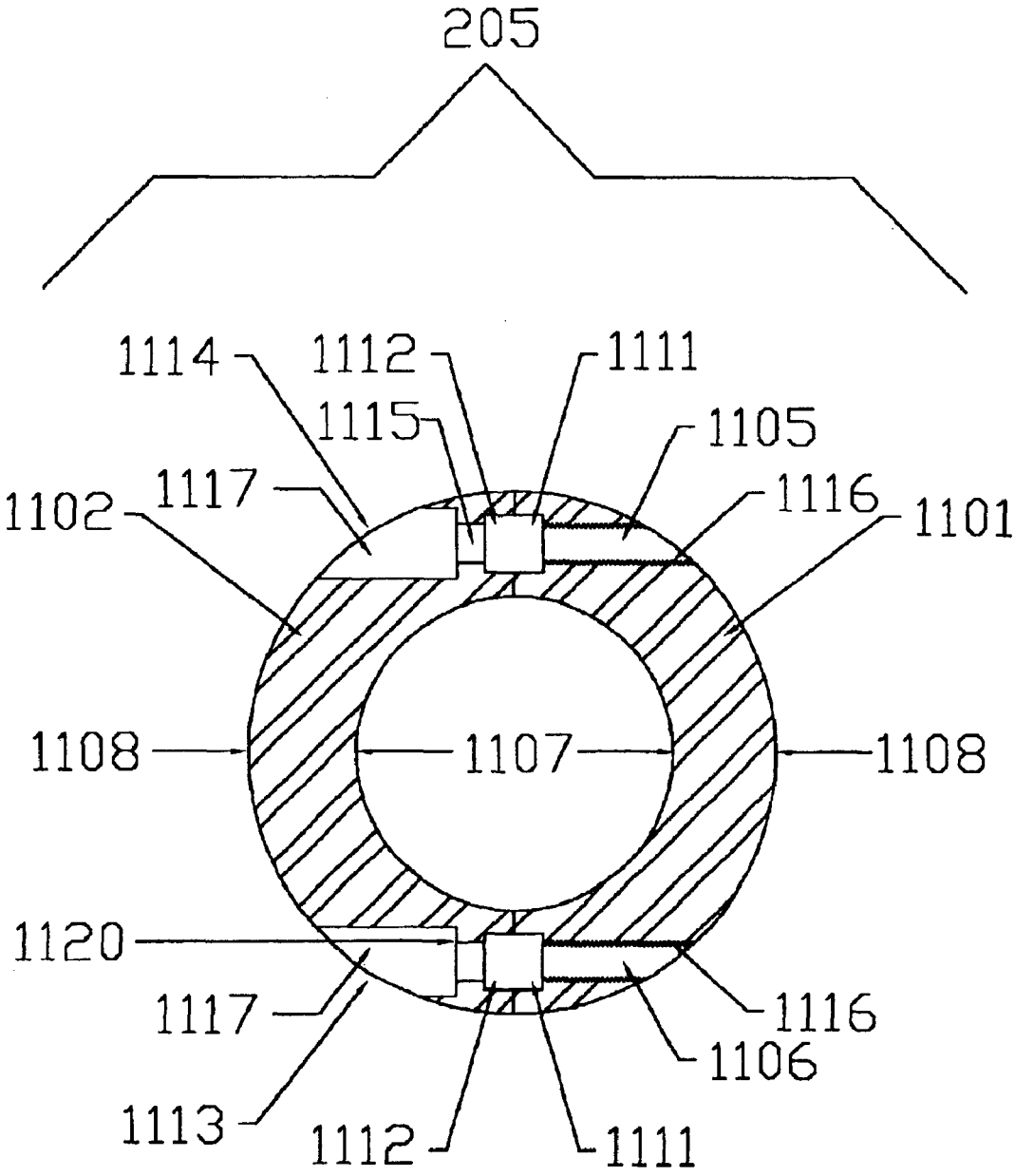
FIG. 11A cross sectional view of the preferred bearing stop.
Figure 11B:
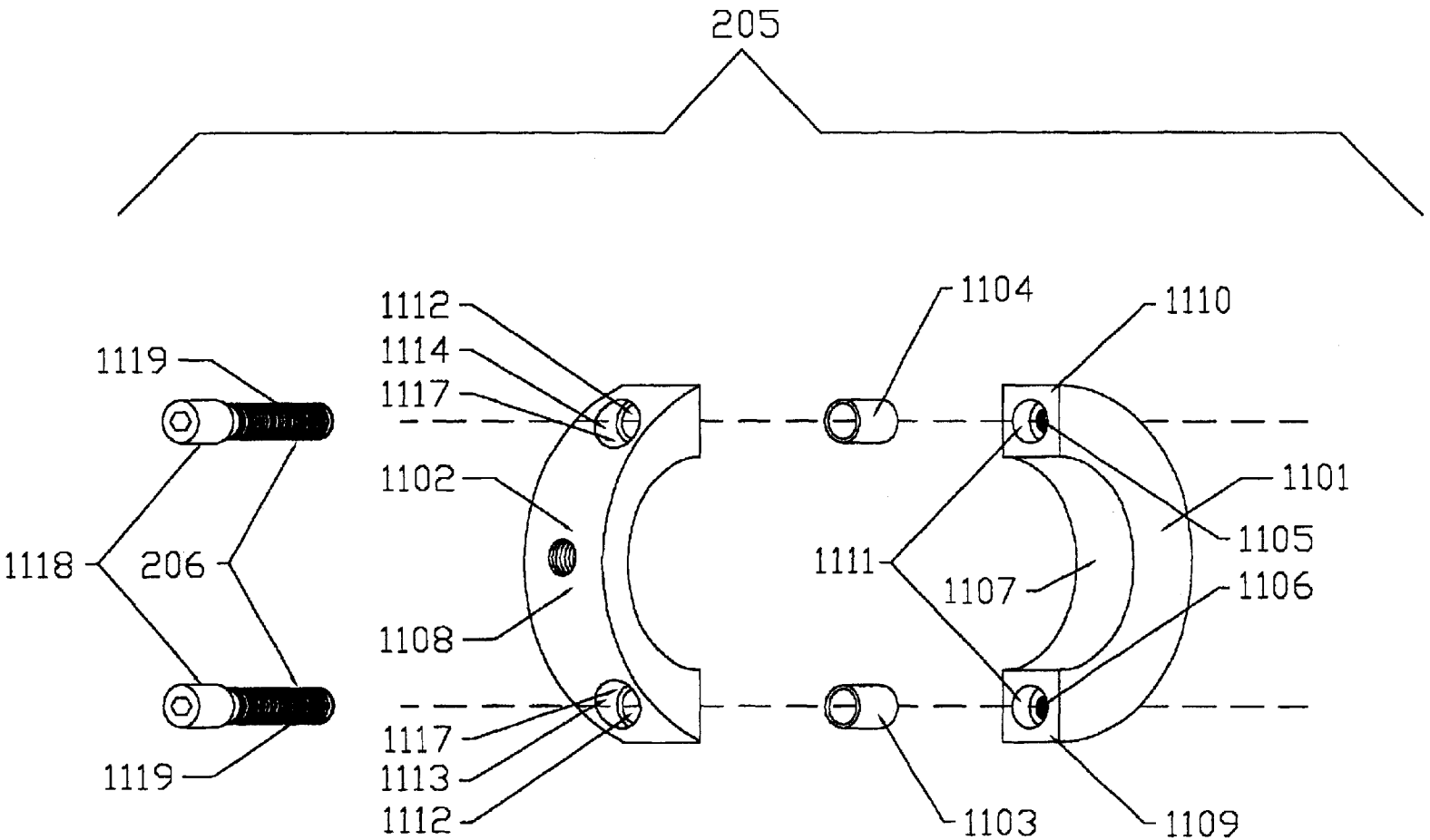
FIG. 11B is an exploded view of the bearing stop.

A circular groove 115 is formed in the bearing mandrel 107 to receive bearing stop 205. Bearing stop 205, shown exploded in FIGS. 1A, 11B and in cross section in FIG. 11A, is formed from two semi-circular pieces 1101, 1102 held together with sleeves 1103, 1104 and bolts 206. Each piece 1101, 1102 has an inner surface 1107, an outer surface 1108 and two joining surfaces 1109, 1110.

A first piece 1101 has holes 1105, 1106 staring at the joining surfaces, 1109, 1110 and extending to the outer surface 1108. The inner sections 1111 of holes 1105, 1106 are shaped to fit approximately ½ of sleeves 1103, 1104. The outer sections 1116 of holes 1105, 1106, extending from the inner sections 1111 to the outer surfaces 1108, are threaded to receive screws 206.

The second piece 1102 has holes 1113, 1114 milled in to the joining surfaces, 1109, 1110 and extending to the outer surface 1108 which align with holes 1105, 1106; allowing screws 206 to be fitted in holes 1113, 1114 and then to be threaded in to holes 1105, 1106, joining the first piece 1101 and second piece 1102 in perfect alignment each time at joining surfaces 1109, 1110, as shown in FIG. 11A. Holes 1113, 1114 have an inner section 1112, which is shaped to receive approximately ½ of sleeves 1103, 1104. Holes 1113, 1114 have sections 1117, which extend from the outer surface 1108 to sections 1115, which then extend to sections 1112. Sections 1117 are larger in diameter than the heads 1118 of bolts 206, counter-setting the bolts 206 in the outer surface 1108. Sections 1115 have a slightly larger diameter than the shaft 1119 of bolts 206, but are smaller than the diameter of the heads 1118, forming lip 1120. The heads 1118 press against lip 1120, pulling the two halves 1101, 1102 together as the bolts 206 are threaded into holes 1105, 1106. Sleeves 1103, 1104 function to align each half 1101, 1102 of the bearing stop 205 to each other so very precise tolerances can be maintained. Any other fasting method that would align the bearing stop 205 evenly around the bearing mandrel 107 would also be contemplated by the present invention.

As shown in FIGS. 2A, 2B, 3 and 4, thrust bearings 116, 117, 118, 119 are placed on either side of bearing stop 205. Any thrust bearings on the forward, or down-hole, side of the bearing stop 205 are referred to as the off-bottom thrust bearings and any thrust bearings on the back, or up-hole, side of the bearing stop 205 are referred to as the on-bottom thrust bearings. In the preferred embodiment there is one off-bottom thrust bearing 116 and three on-bottom thrust bearings 117, 118, 119 for a total of 4 thrust bearings. A different number or arrangement of thrust bearings can be used, depending on the requirements of the mud motor 100 and the relative amounts of weight that is to be applied to the bit during drilling operations.

Figure 3:
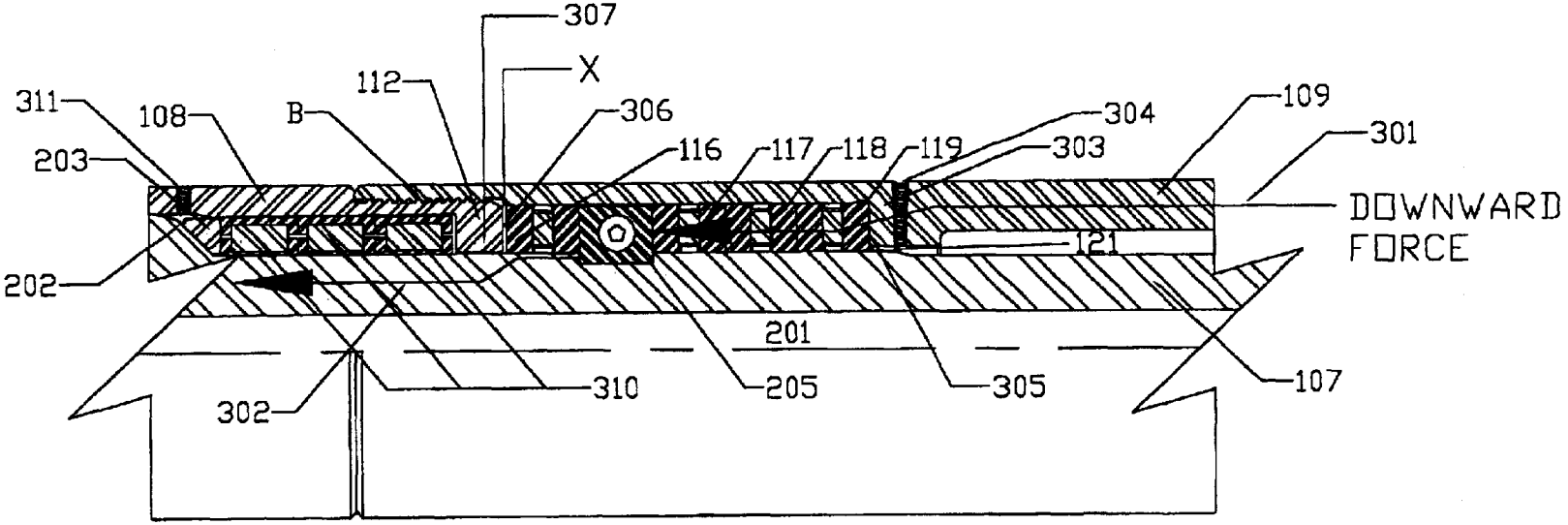
FIG. 3 is a longitudinal, partially cut away, cross sectional view of the bearing section of the present invention when the motor is on-bottom with arrows showing the transfer of force by the bearings.
Figure 4:
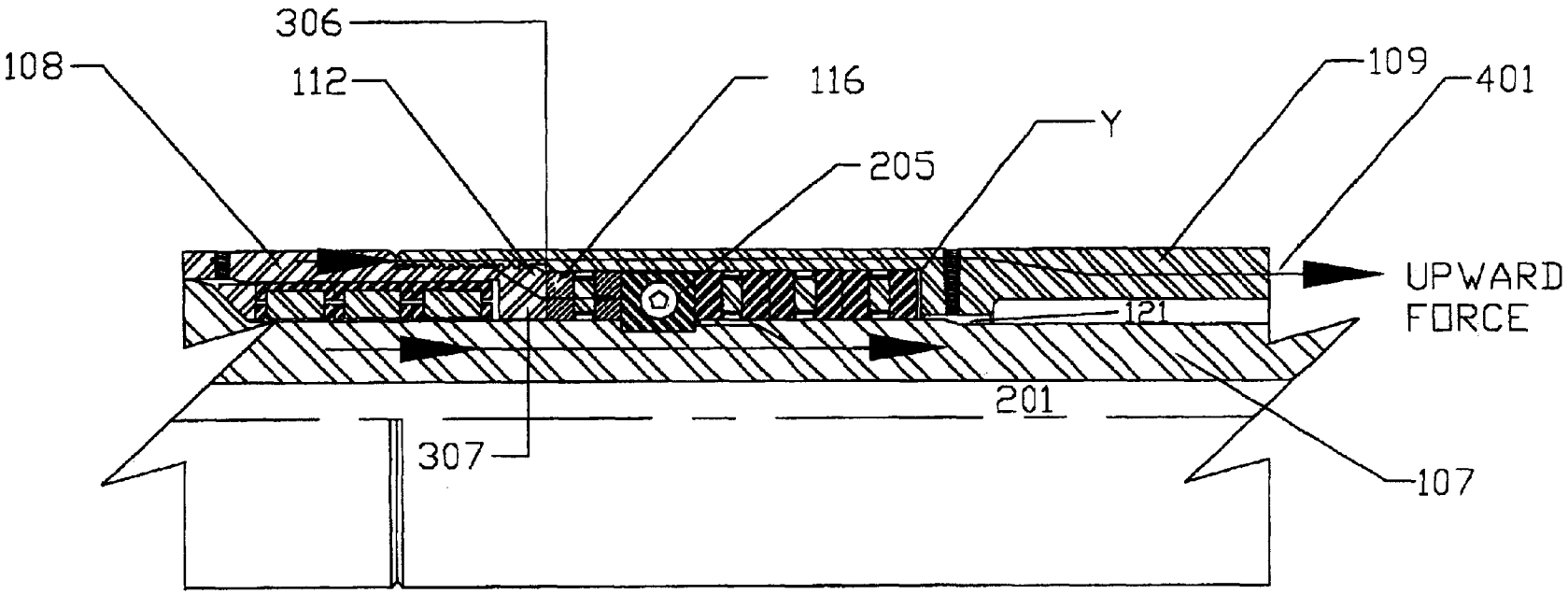
FIG. 4 is a longitudinal, partially cut away, cross sectional view of the bearing section of the present invention when the motor is off-bottom with arrows showing the transfer of force by the bearings.

As shown in FIGS. 3 and 4, the bearing stop 205 and the thrust bearings 116, 117, 118, 119 in combination, function to transfer the weight of the drilling string to the bearing mandrel 107, and thereby to the bit and away from the lower housing 108 during drilling. As shown in FIG. 3, arrows 301, 302 indicate the downward force generated by on-bottom drilling. The bore 121 of outer housing 109 has a circumferential ridge 303 which is placed so that a lower face 305 of ridge 303 is in immediate proximity to thrust bearing 119. Lower housing 108 has a circumferential ridge 307 around the trailing end 112 which is in immediate proximity to thrust bearing 116 when the lower housing 108 is threaded into the outer housing 109 via connection B.

As shown in FIG. 3 by arrows 301 and 302, when downward force is applied for on-bottom drilling, face 305 of ridge 303 of the outer housing 109 presses down, placing outer housing 109 into a state of compression against thrust bearing 119 and thereby transferring the force to thrust bearings 118 and 117 and on against the bearing stop 205. A space X is left between thrust bearing 116 and the face 306 of the ridge 307 of the lower housing 108 when on-bottom force is applied. This removes substantially all of the force on the lower housing 108 and allows substantially all of the force to be transferred to the bearing mandrel 107. The bearing stop 205 functions to transfer the downward force of the drilling string on to the bearing mandrel 107 and on to the bit, as indicated by arrow 302. This allows for the weight of the drill string to be used as a downward force for drilling into hard rock formations.

The design of the bearing stop 205 does two things for the mud motor. First it acts as a solid, easily accessible way to transfer most, potentially all, of the drill string's weight directly to the bit via the bearing mandrel 107 without having to reduce the outside diameter of the bearing mandrel 107, thus keeping the outside diameter as large as possible, thereby decreasing the likelihood of breakage of the bearing mandrel 107. Secondly, the bearing stop 205 acts as an anti-fishing device. Should the bearing mandrel 107 ever part at some point above, or up-hole, from the bearing stop's 205 location, the bearing stop allows the remainder of the mud motor and the bit to be easily pulled out of the hole, acting as a safety device. This saves the drilling contractor money by not having to spend time fishing the lower section of the mud motor out of the hole, decreasing time that drilling operations are down due to a mud motor failure.

A threaded hole 304 tapped in the outer housing 109 through the ridge 303 into the bore 121 and a corresponding threaded hole 311 is tapped through the lower housing 108 behind seal 114. Holes 304, 311 are used for filling the bearing section with oil or other lubricating fluid.

As shown in FIG. 4, when the drill string is lifted off-bottom during a connection or during circulating of the drilling mud, the force, shown by arrow 401, is transferred to the lower housing 108, via the threaded connection B, to the ridge 307 and face 306, thru the off-bottom thrust bearing 116, through the bearing stop 205 pulling the drill bit off of the bottom of the bore hole. This action closes the gap X and creates gap Y.

Figure 7A:
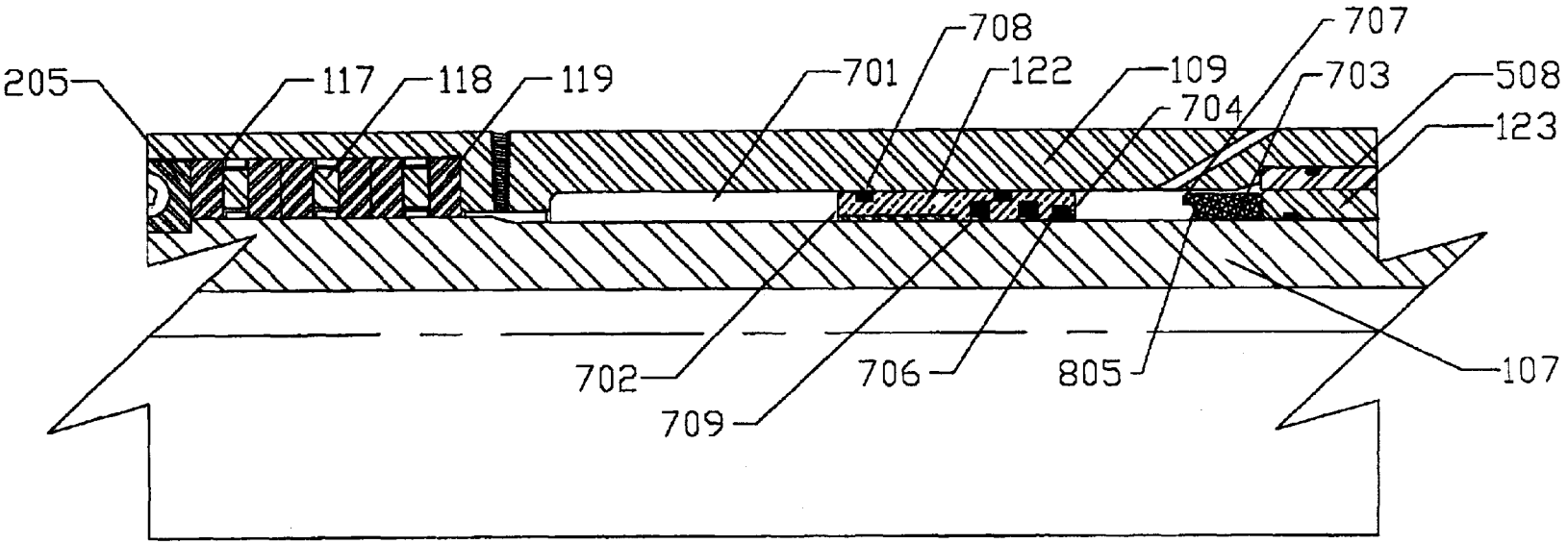
FIGS. 7A and 7B are longitudinal, partially cut away, cross sectional views of the piston in operation.

A circular piston 122 rests on bearing mandrel 107 in a counterbore 701 of outer housing 109 and functions as the upper seal between the lubricant and drilling mud for the bearing region. The bearing region extends from seal 114 to the seals of piston 122, as shown in FIG. 7A, and is filled with a lubricant, which is retained by seal 114 and the piston sealing systems. The seals 113 and 114 and the piston sealing systems prevent contamination of the lubricant by the drilling mud. The major part of the piston sealing system is the first O-ring 708 on the outer diameter of the piston 122 and the first Kalsi 709 seal on the inner diameter of the piston 122, as shown in FIG. 7A. In the preferred embodiment of the invention the lubricant is a synthetic lubricant, preferably a polyester. More preferably, the lubricant is Royal Purple®. The piston 122 slides forward and back within counterbore 701 to allow for the lubricant to expand under the heat and pressure of drilling operations. This prevents the expanding lubricant from damaging any of the internal parts or putting excess pressure on the seals, creating a leakage, which would allow drilling mud to seep into the bearings, causing a failure. The inside diameter of the counterbore 701 of the outer housing 109 is chromed to increase the ease of the piston 122 sliding action and to create a smoother surface to allow for a tighter more containing seal without prematurely wearing out the seals due to a rough finish on the inside diameter from machining marks.

Figure 7B:
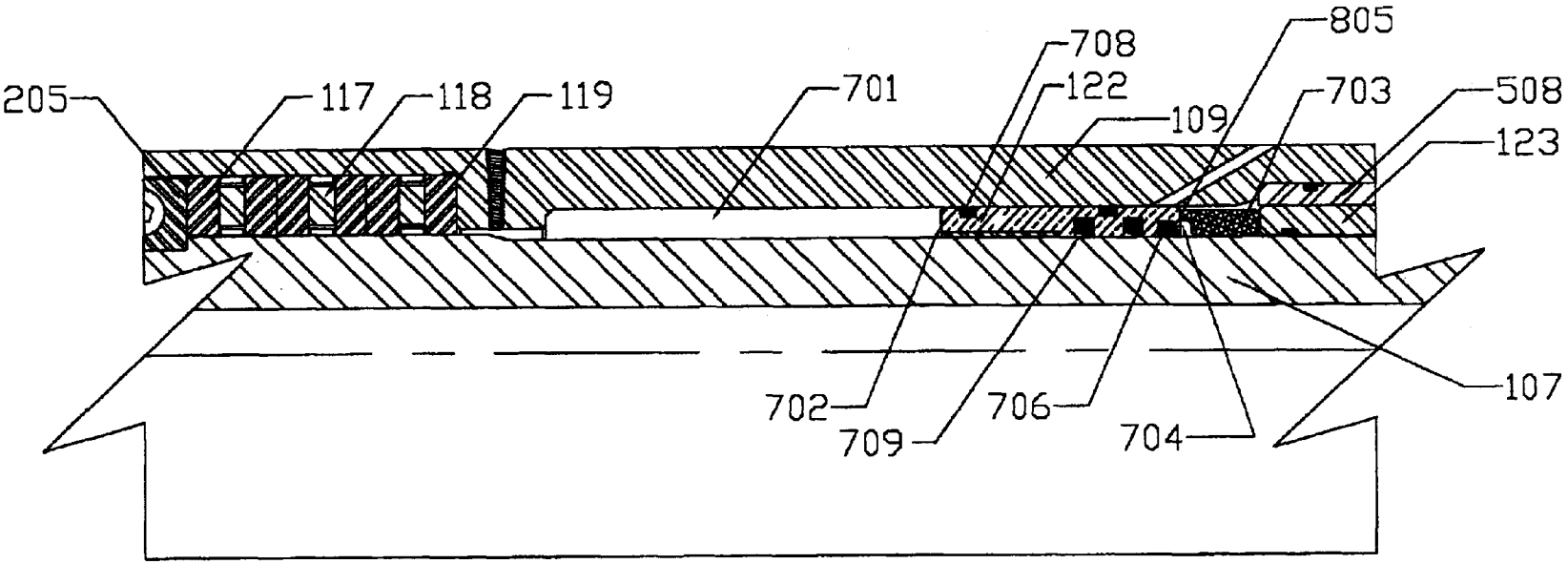

Referring next to FIG. 7B, under full expansion of the lubricant the piston 122 slides all the way back in the counterbore 701 and back face 704 of the piston 122 rests against forward face 805 of piston stop 703, which is made of a polyurethane material. Piston stop 703 prevents the piston 122 from pushing against the bearing adaptor 123 and causing damage either to the bearing adaptor 123 or the piston 122. The back face 704 of piston 122 has a wiper seal 706 to ensure no drilling mud slides under the piston 122 as the lubricant expands. Piston stop 703 has a protruding lip 707 on the upper edge of the forward face 805 to prevent the wiper seal 706 from being damaged when the piston 122 is pressed against the piston stop 703.

Figure 9:
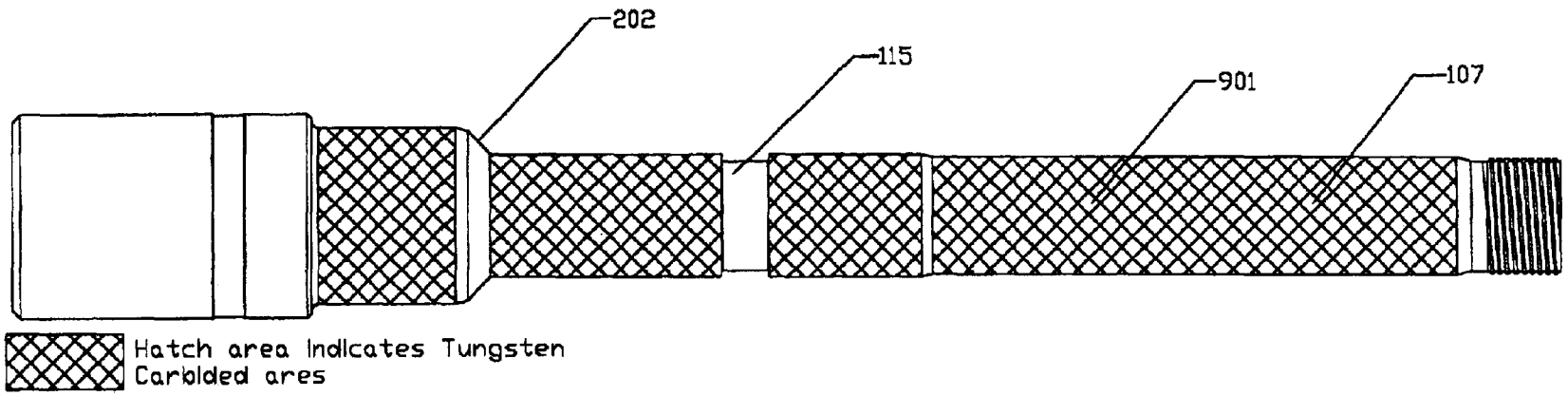
FIG. 9 is a perspective view of the bearing mandrel showing the areas of tungsten carbide coating.

As shown in FIG. 9, the bearing mandrel 107 has all of the areas where seals or bearings rest against the outer surface 901 coated with a layer of tungsten carbide 0.020" thick to increase its life. The coated areas are shown as cross-hatching in FIG. 9.

Figure 5:
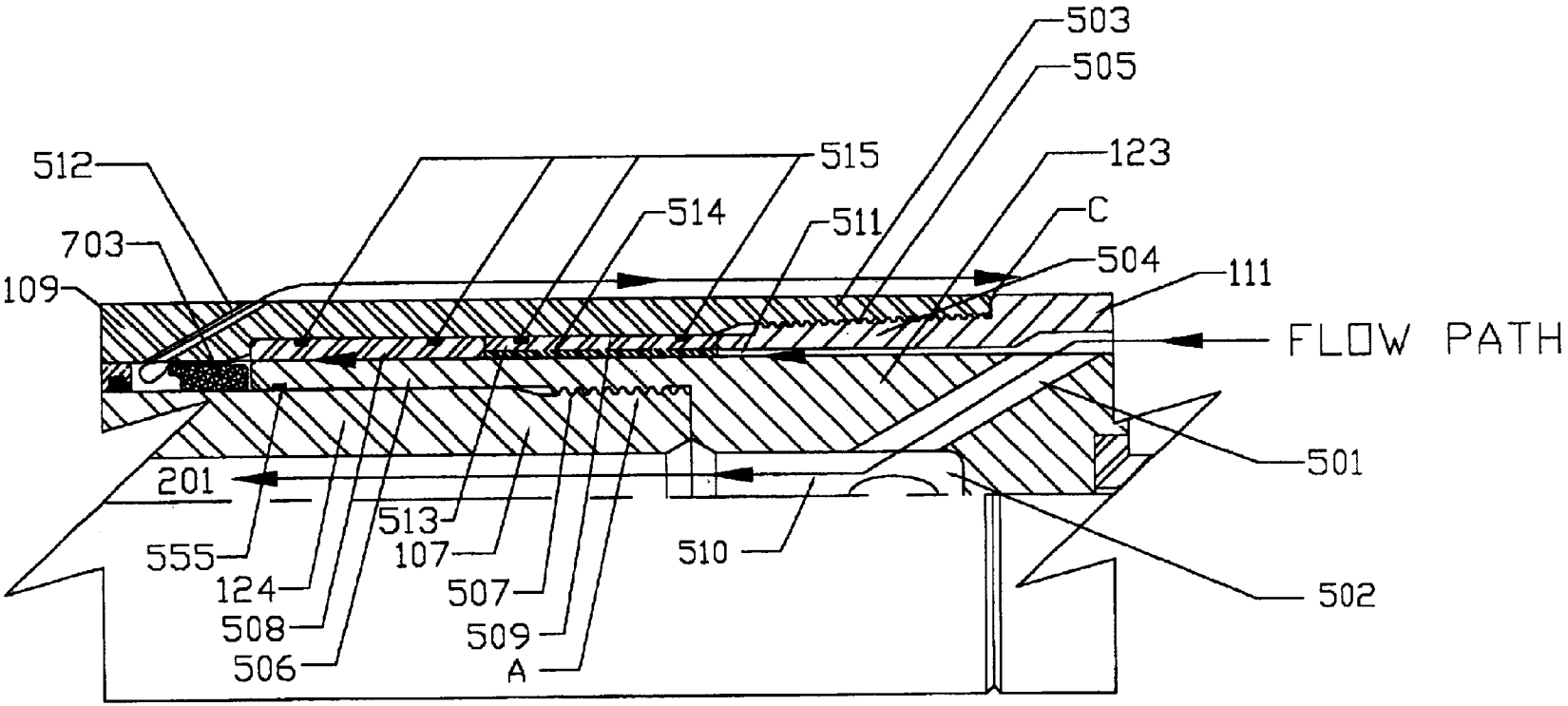
FIG. 5 is a longitudinal, partially cut away, cross sectional view of the marine bearing and bearing adaptor with arrows showing the flow of the drilling mud in operation.

Referring next to FIGS. 2B–2C, and 5, a circular bearing adapter 123 is threaded onto the back end 124 of the bearing mandrel 107 and has a portion 506 extending forward over the outer diameter of the rear threaded surface of the bearing mandrel 107. This joint is indicated by the letter A in FIGS. 1A–1B.

Figure 12A:
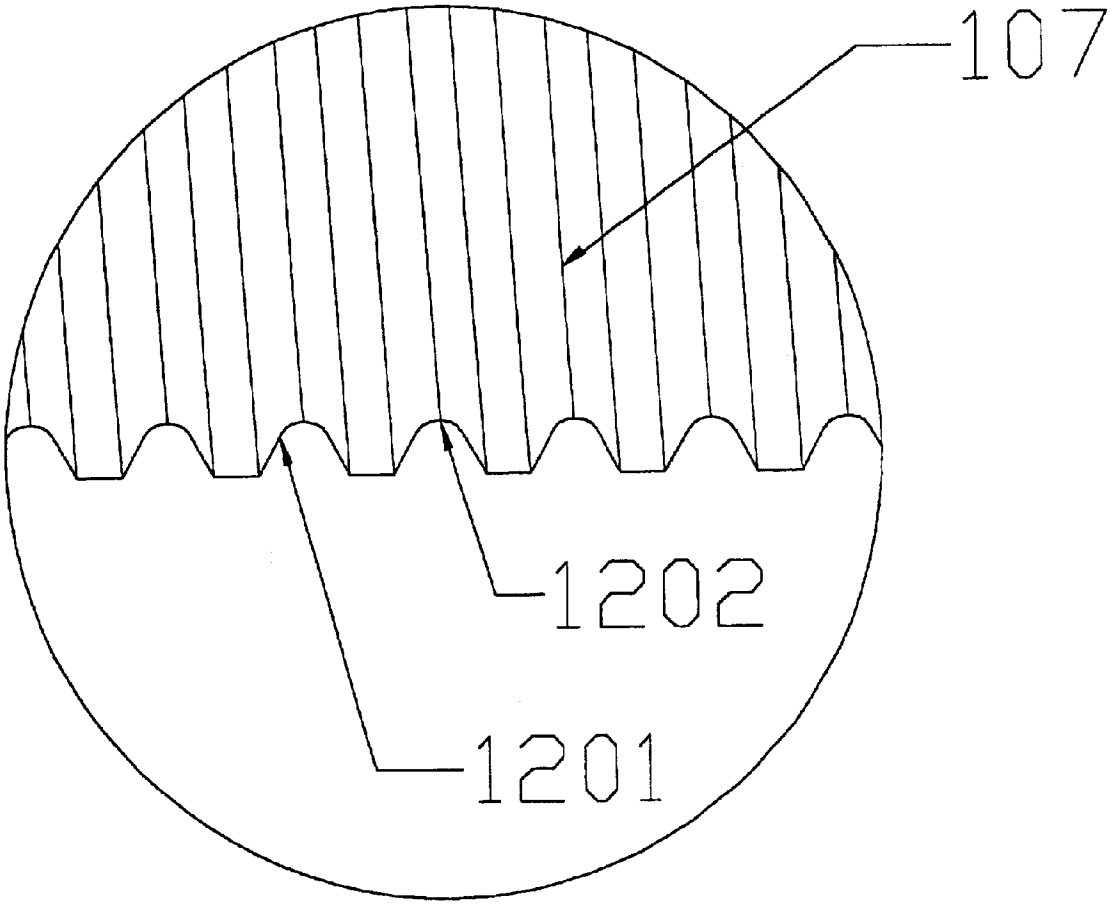
FIG. 12A is a detailed view of the preferred threads on the bearing mandrel.
Figure 12B:
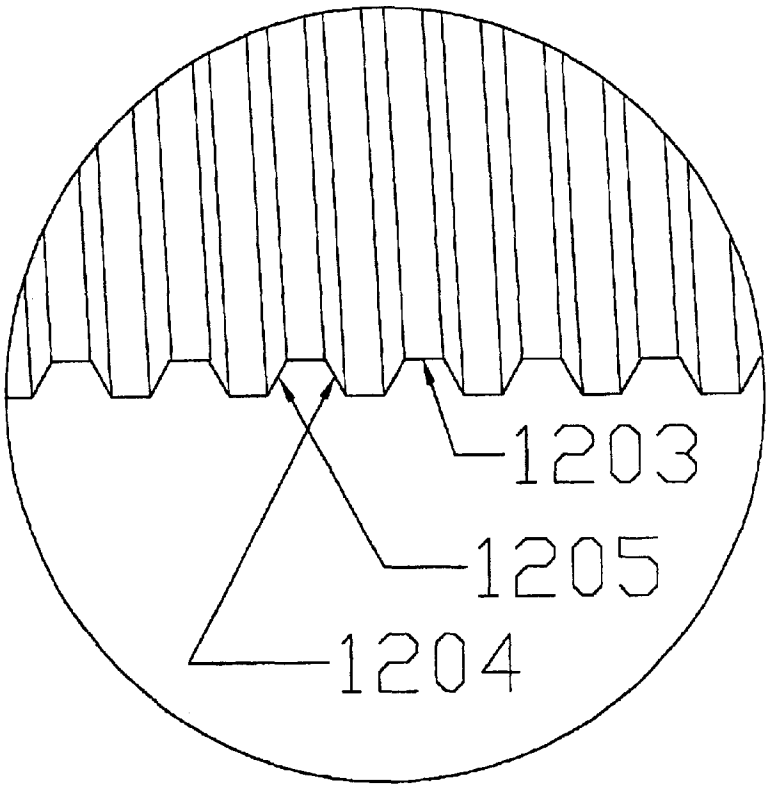
FIG 12B Prior Art
FIG. 12B is a detailed view of the prior art thread profile.

A common problem is the breakage of the bearing mandrel 107 at the forward most thread groove 507. As shown in FIG. 12B the prior art threads used in the drilling industry are flat bottom threads 1203 with sharp thread angles 1204, and 1205. Each of the angles 1204 and 1205 creates a stress riser within the thread 1203 and, thereby, within the body of the bearing mandrel 107, causing fatigue cracks which result in breakage. The present invention has rounded threads 1201 as shown in FIG. 12A. The rounded threads 1201 have curved bottoms 1202. This removes the stress riser from the threads and causes a significant reduction in the frequency of breakage of the bearing mandrel 107. These rounded threads have been traditionally used in the food industry, not in the oil field.

Referring again to FIGS. 2C, and 5, the bearing adaptor 123 has one or more holes 501 about the circumference of the adaptor 123 extending from the exterior to a central bore 502 to provide for drilling mudflow, indicated by arrow 510. As shown in FIG. 5 the central bore 502 of the bearing adaptor 123 communicates directly with the bore 201 of the bearing mandrel 107, thus providing the mudflow through the bearing mandrel 107 to the bit. Hole 501 is angled backward to increase the ease of mudflow. The number of holes 501 is dependant on the total mudflow desired to the bit. For standard applications the number of holes 501 is four.

Figure 10:
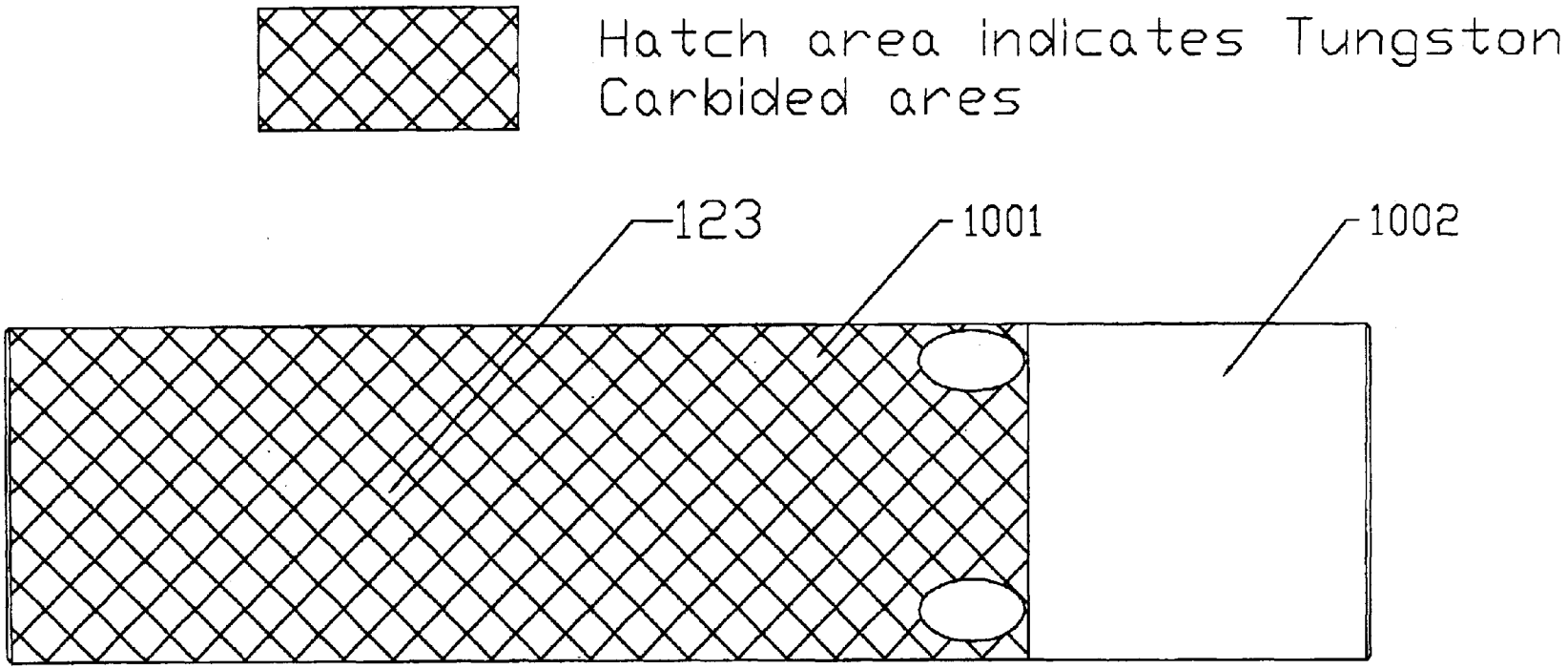
FIG. 10 is a perspective view of the bearing adaptor showing the areas of coating.

The back end 503 outer housing 109 is threaded on to the front end 504 of flex housing 111 at threads 505. This joint, indicated by the letter C in FIGS. 1A–1B, is located back from the joint A between the bearing mandrel 107 and the bearing adaptor 123. Marine bearing 509 and female flow restrictor 508, as shown in FIG. 5, rotationally support the bearing adaptor 123. The drilling mud flows down between the inside of the marine bearing 509 and the inside diameter of the female flow restrictor 508 and the outside diameter of the bearing adaptor 123 as indicated by arrow 511. As shown in FIG. 10, this mudflow cools the marine bearing and outer surface 1001 of the bearing adaptor 123. The majority of the outer surface of the bearing adaptor is coated in a 0.040" layer of tungsten carbide to reduce abrasion of the surface 1001 by the drilling mud. The trailing end 1002 of the bearing adaptor 123 is left uncoated to allow for use of standard tools on the bearing adaptor 123 when assembling the mud motor 100. The mud then flows over the piston stop 703 and out vent holes 512, as shown in FIG. 5. The female flow restrictor 508 acts to control the flow, and therefore pressure, of the mud on to the piston 122. This prevents over pressurization of the lubricant in the bearing section and erosion of the piston.

Figure 8:
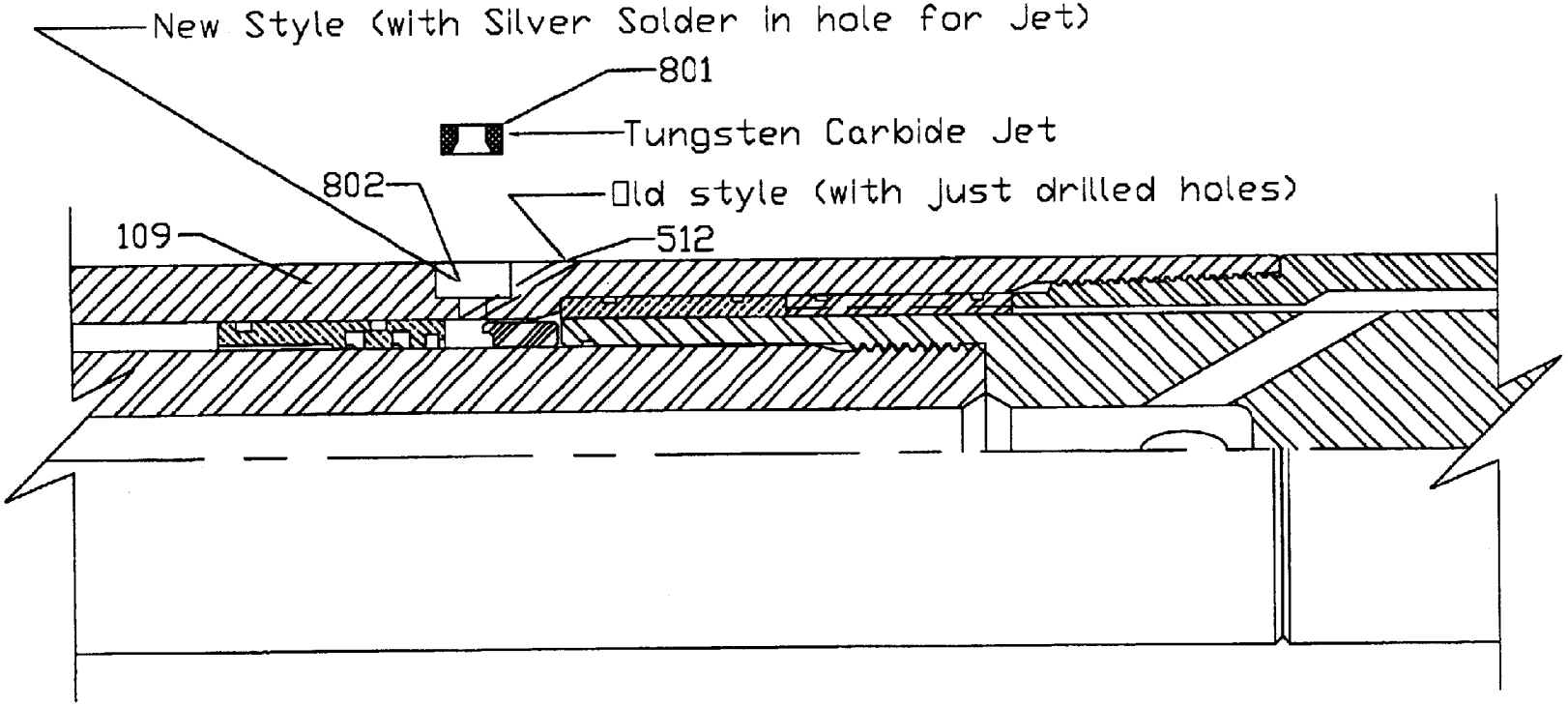
FIG. 8 is a longitudinal, partially cut away, cross sectional view of an alternate embodiment of the present invention with a tungsten carbide insert inset into a profile in the outer housing.

In an alternate embodiment, shown in FIG. 8, the vent hole 512, which is simply drilled trough the outer housing 109, is replaced with a tungsten carbide sleeve 801 which is placed into a profile 802 in the outer housing 109. This prevents erosion or "fluid cutting" of the old vent hole 512, which is a common problem in prior art mud motors.

The marine bearing has two layers, a rigid outer layer 513 and an inner layer 514 made of a elastomeric rubber compound. The outer layer 513 can be made of either metal or any sufficiently rigid plastic. Marine bearings are well known to the art of bearings, and therefore will not be described in detail here.

The female flow restrictor 508, shown in FIG. 5 is a metal sleeve with a tungsten carbide layer on the inside. The tungsten carbide layer can either be sprayed on the inside or a tungsten carbide sleeve can be inserted into the metal sleeve and pressed fit into the metal sleeve in a known manner. The internal diameter $d_2$ of the female flow restrictor 508 is determined with great specificity so that the flow restrictor 508 fits with exacting tolerances over the external diameter $d_3$ of the bearing adaptor 123 effectively controlling the rate of flow of the drilling mud through this area. The difference between the external diameter $d_3$ of the bearing adaptor 123 and in internal diameter $d_2$ of the female flow restrictor 508 must be less than 0.003 to 0.005 on a side for a value of 0.006 to 0.010" of total clearance.

Seals 515 are located between the outside diameter of the marine bearing 509, the outside diameter of the female flow restrictor 508 and the inside diameter of the outer housing 109. Seals 515 serve two functions. The first is to prevent any drilling mud from getting between the outer housing 109, the female flow restrictor 508 and the marine bearing 509. The second function of seals 515 is to prevent the female flow restrictor 508 and marine bearing 509 from spinning within the inside diameter of the outer housing 109. O-ring 555 prevents drilling mud from entering into the threaded connection A. The metal-to-metal contact of the threads between the trailing end of the bearing mandrel 107 and the forward end of the bearing adapter 123 prevents fluid from entering in that direction.

Figure 6:
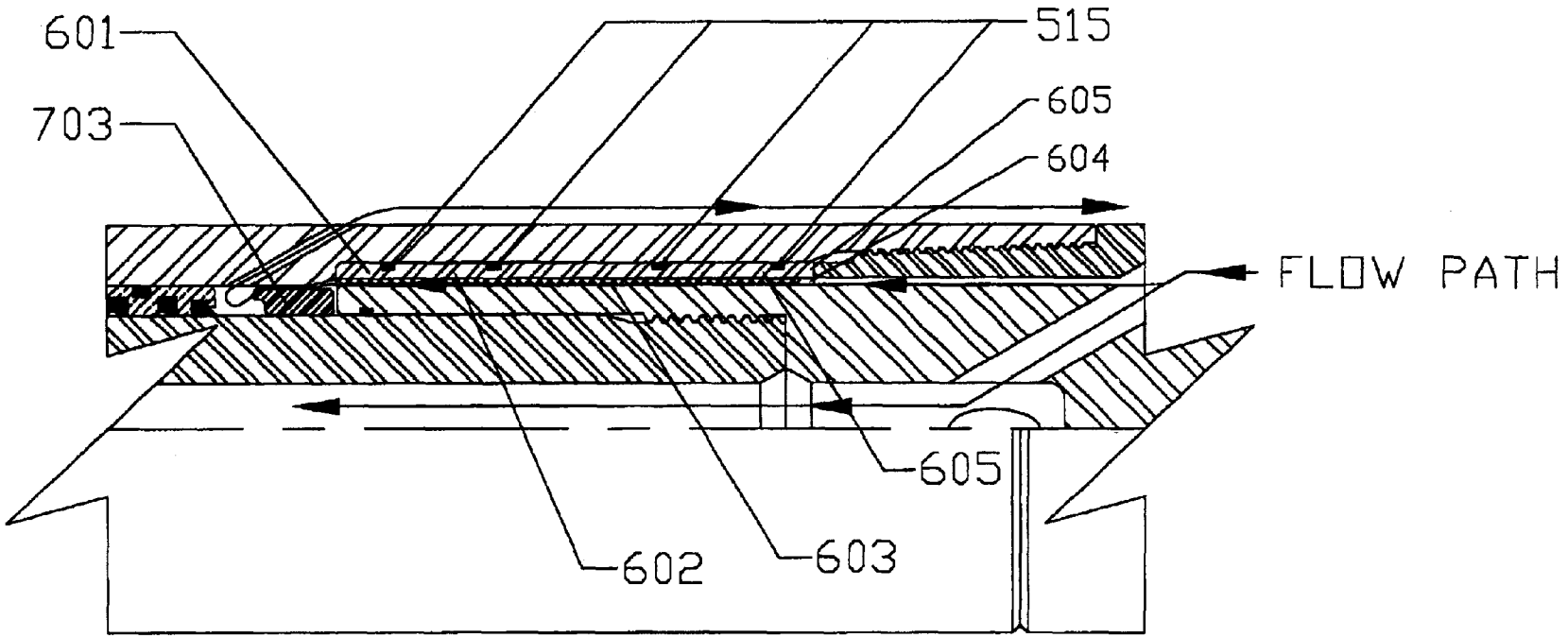
FIG. 6 is a longitudinal, partially cut away, cross sectional view of an alternate embodiment with a combination sleeve and bearing adaptor with arrows showing the flow of the drilling mud in operation.

An alternate embodiment, shown in FIG. 6, utilizes a single combination sleeve 601 in place of the marine bearing 509 and the female flow restrictor 508. The combination sleeve 601 serves the function of both the marine bearing 509 and the female flow restrictor 508. The combination sleeve 601 has an outer sleeve 602 of metal or other rigid material, e.g., it is believed that there are ceramic, plastic or hybrid materials which function as the outer sleeve 602. Any material chosen has to withstand up to 300° F.+ and be able to act as a radial bearing without disintegrating and has to posses a high degree of abrasion resistance. The inner sleeve 603 is tungsten carbide and can either be a spray on coat or a pressed in sleeve as described above. The combination sleeve 601 also has an internal diameter of $d_2$. The combination sleeve 601 has seals 515 as described above. A length 604 of the internal diameter of the outer sleeve 602 at the trailing end 605 is left uncoated with tungsten carbide to allow for adjustments in the length of the combination sleeve 601 without having to cut tungsten carbide with a lathe insert.

Figure 2D:
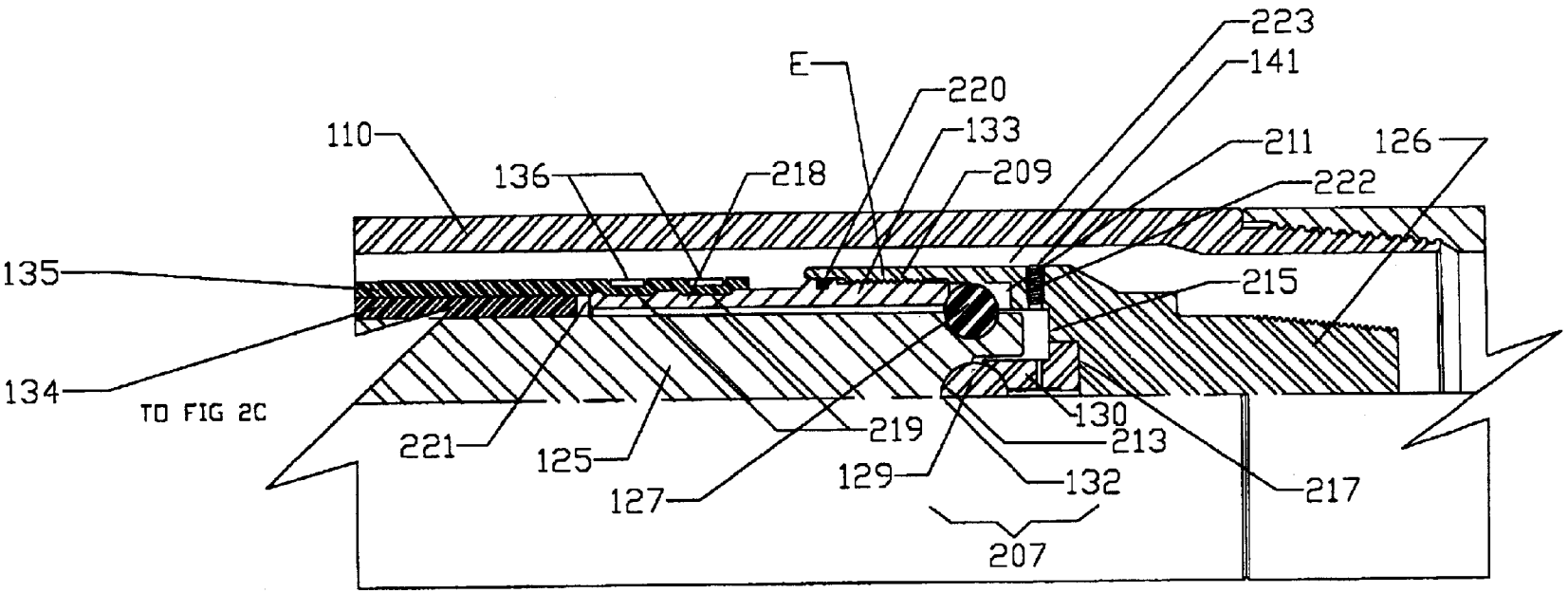

As shown in FIGS. 1B, 2C and 2D, the assembly 100 of the mud motor has a flex shaft 125 (or drive shaft) rotationally coupling a rotor adaptor 126 and the bearing adaptor 123. The bearing adaptor 123 and the rotor adaptor each have internally threaded skirt portions 208 and 209, respectively. Each skirt portion 208 and 209 has an internal end wall 214, 215, respectively. At each end of the flex shaft 125 is a constant velocity universal joint 207.

The universal joint 207 comprises a plurality of circumferentially spaced balls 127 seated in a plurality of dimples 128 in the flex shaft 125 and in a plurality of corresponding axially extending grooves 210, 211 in the skirt portions 208 and 209 of the bearing adapter 123 and the rotor adapter 126 respectively. In the preferred embodiment there are six balls 127. The universal joints 207 also have recesses 212, 213 formed on each end 131, 132 of the flex shaft 125 and located on the axis of rotation. Recesses 131, 132 are shaped to receive balls 129 and ball seats 130. The ball seats 130 are set in recess 216 in the end wall 214 of the bearing adaptor 123 and in recess 217 in the end wall 215 of the rotor adaptor 126 with an interference fit.

Figure 13A:
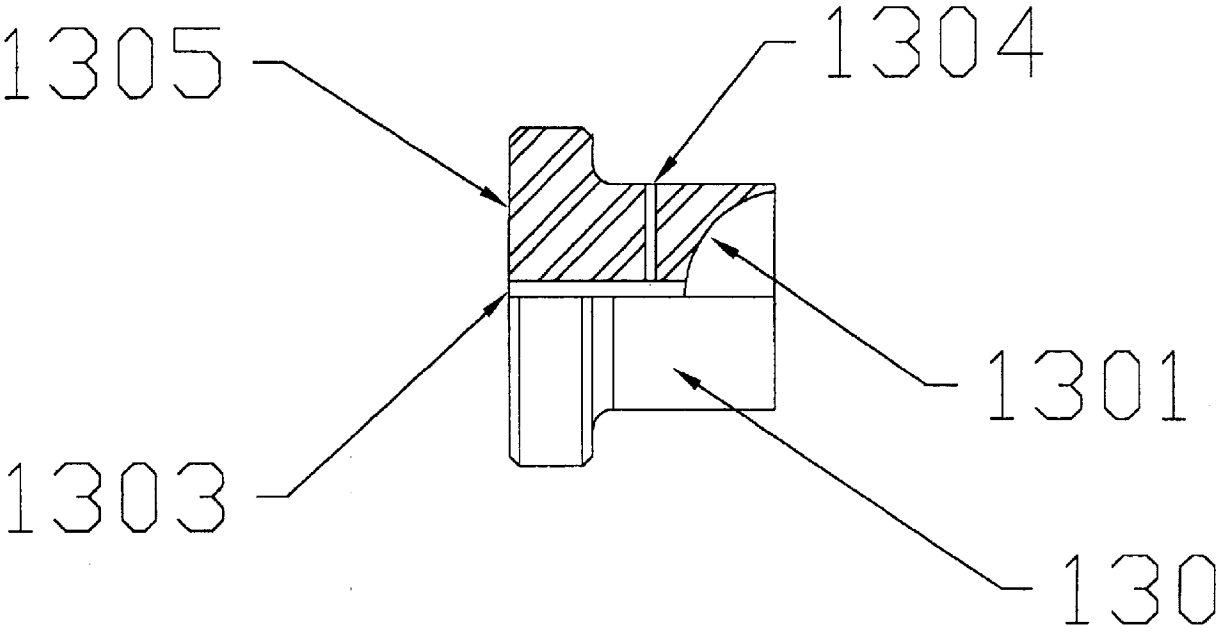
FIGS. 13A and 13B are longitudinal cross section of ball seat and a top perspective view of a ball seat, respectively.
Figure 13B:
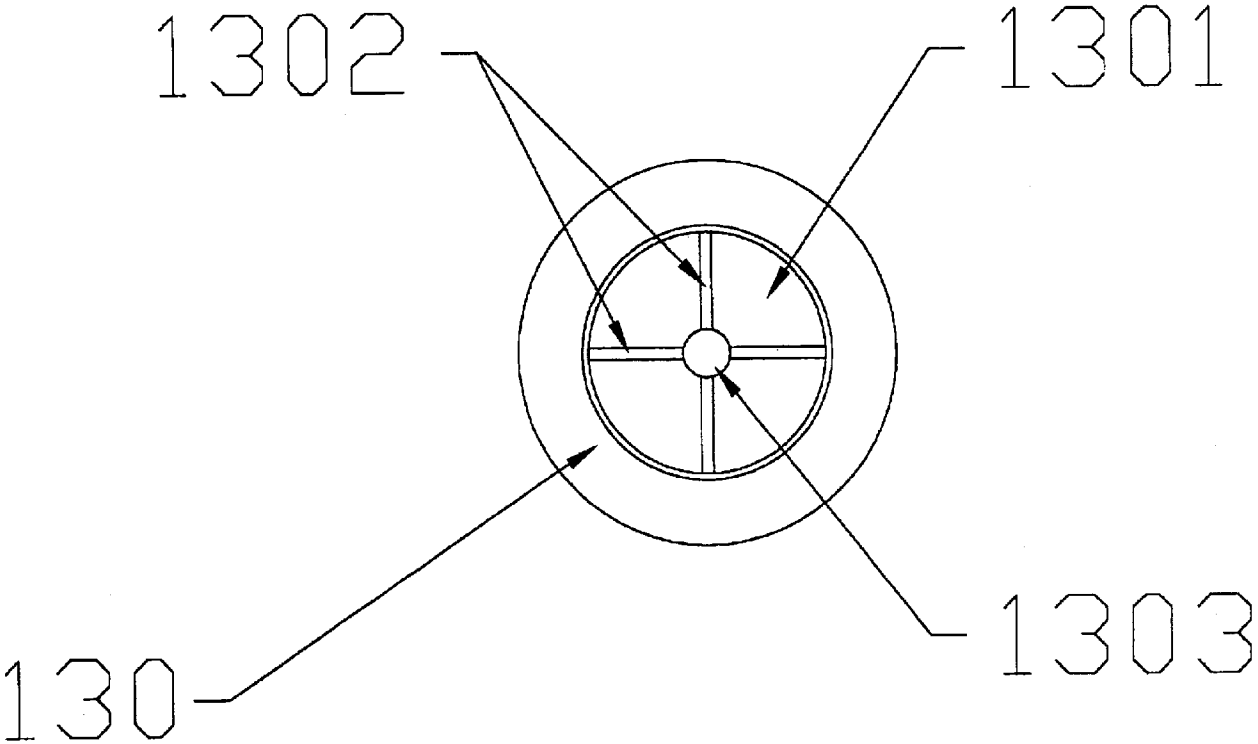

The ball seats 130 have a concave top surface 1301 to exactly fit ball 129's profile, as shown in FIGS. 13A and 13B. To allow lubricant to easily flow in between the top surface 1301 and the ball 129, the ball seat 130 has one or more flow groves 1302 in the top surface. Flow Groves 1302 also function as wear gauges for the ball seat 130 to allow the user to know when the ball seat 130 needs to be replaced. To further increase the flow of lubricant flow holes 1303 and 1304 are provided. Flow hole 1303 extends from the top surface 1301 to the bottom surface 1305. Hole 1304 extends from one side to the other and is perpendicular to and intersects with hole 1303.

Two bonnets 133 are threaded into the skirt portions 208, 209 of the bearing adaptor 123 and the rotor adaptor 126, respectively, at joints D and E, as shown in FIGS. 1B, 2C and 2D. Seal 220 is placed between the bearing adaptor 123 and the bonnet 133 and the rotor adaptor 126 and the bonnet 133 to prevent contamination from entering the threads.

The bonnets 133 have seal attachment sections 218 which extend beyond the bearing adaptor 123 and the rotor adaptor 126 toward the center of flex shaft 125. Each attachment section 218 has at least one grove 219 extending around the outer circumference which is located near the front edge 221 of bonnets 133. The preferred embodiment has two grooves 219, which are substantially parallel and spaced apart. Polyurethane sleeve 134 is slid over the flex shaft 125 and sets in the middle of the flex shaft 125 and extends between the front edges 221 of the bonnets 133. A Space 224 is left between the sleeve 134 and the front edges 221. Rubber sleeve 135 slides over the bonnets 133, flex shaft 125 and sleeve 134 and extends over both attachment sections 218 and grooves 219. Cinch straps 136 are slid over the sleeve 135 and set above grooves 219. The cinch straps 136 are tightened down on to the sleeve 135 into grooves 219, sealing the transmission section 200 from all drilling fluids.

Rotor adapter 126 and bearing adapter 123 have threaded holes 222 which extend from the outer surface 223 to internal end wall surface 215 on the rotor adapter 126 and on the bearing adapter 123. Holes 222 are used to fill the transmission section 200 with a grease lubricant. Screws 141 are then threaded into holes 222 to seal the transmission section 200. In the preferred embodiment Royal Purple™ grease is used to lubricate the transmission section.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A mud motor assembly attachable to a drill bit on its down hole end and to a power section on the other end comprising a) a tri-partite external housing including a lower housing section with an internal circumferential ridge around its trailing end down hole to a bearing stop on a bearing mandrel, an outer housing section with an internal ridge positioned proximate to its down hole end and a flex housing section connectable to a power section housing; the lower, outer and flex housing sections being attached to each other by threaded connections;

b) the bearing mandrel, fitted within the lower and outer housing sections of a tri-partite housing which has, at its down hole end, an inner threaded section for connection to a drill bit, and on its outer surface a frustoconical shoulder proximate to the up hole end of the internally threaded section, a circular groove spaced apart from the frustoconical shoulder toward the up end;

c) a plurality of circular pressure seal means encircling the bearing mandrel and adjacent the frustoconical shoulder for preventing unwanted leakage of fluids;

d) a radial ring means encircling the bearing mandrel and shaped to conform to the frustoconical shoulder and positioned adjacent the first pressure seal means for backing the pressure seal means;

e) radial bearing means encircling the bearing mandrel and positioned up hole of and adjacent to the radial ring for rotationally supporting the bearing mandrel within the lower housing section;

f) at least one on off bottom thrust bearing encircling the bearing mandrel and adjacent and up hole to the internal ridge of the inner housing;

g) a bearing stop assembly removably attached to the bearing mandrel and positioned up hole to the internal ridge of the inner housing;

h) at least one on bottom thrust bearing adjacent to and up hole of the bearing stop;

i) a circular piston assembly positioned on the bearing mandrel within a counterbore machined on the outer housing section for separating lubricant in the bearing seal means, extending from the pressure seal means to the down hole end of the piston means, from the drilling mud;

j) a piston stop positioned on the bearing mandrel adjacent the circular piston assembly including a piston to prevent damage to adjacent moving parts;

k) a circular bearing adaptor attached to and partially extending over the up hole end of the bearing mandrel;

l) a transmission section including a conical bearing adapter, with spaced apart holes around its exterior surface which lead to a central bore and provide a channel for drilling mud flow into the rear of the bearing mandrel and thence to the drill bit, with a forward portion extending over a threaded portion of the outer surface of the bearing mandrel;

m) a transmission assembly, at least partially within a flex housing including 1) a flex shaft rotationally connected to a rotor adaptor and a bearing adaptor, each of which have internally threaded skirt portions with internal end walls;

2) a constant velocity universal joint connected to each end of the flex shaft, the universal joints having ball seats with grooved concave top surfaces terminating in at least one flow hole at the bottom of the concave top surface in which load bearing balls are positioned;

3) each of two bonnets are connected to the skirt portions of the rotor adaptor and bearing adaptor via a seal.

2. The mud motor of claim 1 further including a power section including a rotor and a stator.

3. The mud motor of claim 1 wherein the outer diameter of the bearing mandrel decreases to a diameter which is sized at a preferred ratio of about 0.582 to the diameter of the preferred mud motor housing having a diameter of 6.75 inches.

4. The mud motor of claim 1 wherein the lower housing is sealed to the bearing mandrel with at least a poly pack type seal.

5. The mud motor of claim 1 wherein the lower housing is sealed to the bearing mandrel with multiple seals.

6. The mud motor of claim 1 wherein a plurality of compensating pressure assemblies are spaced circumferentially around the lower housing.

7. The mud motor of claim 1 wherein the bearing stop is formed from two semicircular pieces.

8. The mud motor of claim 7 wherein;

the semicircular pieces are held together through the use of bolt seats in one of the semicircular pieces, bolts seated in the bolt seats;

sleeves within which the bolts are enclosed and threaded bores in the other semicircular piece.

9. The mud motor of claim 1 wherein a plurality of on bottom thrust bearings are utilized.

10. The mud motor of claim 1 wherein the bearing stop is configured for easy pulling of the bearing mandrel from the bore hole.

11. The mud motor of claim 1 wherein the lubricant between the plurality of piston seals is a synthetic lubricant.

12. The mud motor of claim 1 wherein the inside diameter of the counter bore of the outer housing is chromed.

13. The mud motor of claim 1 wherein the piston stop is constructed of a polyurethane material of predetermined specifications.

14. The mud motor of claim 13 wherein the piston stop has a protruding lip on the upper edge of its forward face.

15. The mud motor of claim 1 wherein the back face of the piston includes a wiper seal.

16. The mud motor of claim 1 wherein the threads on the bearing mandrel and associated ports are rounded and have curved bottoms.

17. The mud motor of claim 2 wherein the holes in the bearing adaptor are angled uphole and the numbers of the holes increases proportionately as the predetermined total mud flow increases.

18. The mud motor of claim 1 wherein a major portion of the outer surface of the bearing adaptor is coated with a coating of tungsten carbide to reduce abrasion.

19. The mud motor of claim 1 wherein the drilling mud flows downwardly into a vent hole and then between the inside of a marine bearing and the inside diameter of a female flow restrictor and the outside diameter of the bearing adaptor.

20. The mud motor of claim 19 wherein the marine bearing has a rigid outer layer and an elastomeric inner layer of predetermined specifications.

21. The mud motor of claim 19 wherein the vent hole is replaced by a carbide sleeve placed in a profile in the outer housing.

22. The mud motor of claim 19 wherein the drilling mud flows through a single combination sleeve having a tungsten carbide inner coating.

23. The mud motor of claim 1 wherein the universal joint includes a flex shaft in which a plurality of circumferentially spaced dimples are located and in which an equal plurality of balls are seated.

24. The mud motor of claim 1 wherein the bonnets have seal attachment sections extending beyond the circular bearing adaptor and the rotor adaptor toward the center of the flex shaft.

25. The mud motor of claim 23 wherein each attachment section has at least one groove extending around the outer circumference which is located proximate the front edge of the bonnets.

26. The mud motor of claim 1 wherein a polyurethane sleeve encloses the flex shaft and sits in the middle of the flex shaft and extends between the front edges of the bonnet.

27. The mud motor of claim 26 wherein a rubber sleeve slides over the bonnet, flex shaft and sleeve.

28. The mud motor of claim 1 wherein cinch straps are tightened around the sleeves and into the grooves sealing the transmission section from the drilling fluids.

29. The mud motor of claim 1 wherein the rotor adaptor and the bearing adaptor have threaded holes which extend from an outer surface to an inner surface on the rotor adaptor and on the bearing adaptor functioning to protect the lubricant from contaminants.

30. A bearing madrel for a mud motor assembly attachable to a drill bit on its down hole end and to a power section on the other end, said bearing mandrel comprising:

an inner threaded section for connection to the drill bit, and on an outer surface a frustoconical shoulder proximate to the up hole end of the internally threaded section, a circular groove spaced apart from the frustoconical shoulder toward the up hole end;

a plurality of circular pressure seal means encircling the bearing mandrel and adjacent the frustoconical shoulder for preventing unwanted leakage of fluids;

a radial ring means encircling the bearing mandrel and shaped to conform to the frustoconical shoulder and positioned adjacent the first pressure seal means for backing the pressure seal means;

radial bearing means encircling the bearing mandrel and positioned up hole of and adjacent to the radial ring for rotationally supporting the bearing mandrel within the lower housing section;

at least one on off bottom thrust bearing encircling the bearing mandrel and adjacent and up hole to the internal ridge of the inner housing;

a bearing stop assembly removably attached to the bearing mandrel and positioned up hole to the internal ridge of the inner housing; and at least one on bottom thrust bearing adjacent to and up hole of the bearing stop.

* * * * *